United States Patent [19]

Kuntz

[11] 4,031,687

[45] June 28, 1977

[54] FORMATION OF ELEVATED STRUCTURES

[75] Inventor: Howard W. Kuntz, Miami, Fla.

[73] Assignee: Raymond International Inc., Houston, Tex.

[22] Filed: Aug. 2, 1976

[21] Appl. No.: 710,470

[52] U.S. Cl. ..... 52/742; 52/169.9; 52/274; 52/88

[51] Int. Cl.[2] ..... E04B 1/00; E02D 27/00

[58] Field of Search ..... 52/742, 88, 745, 80, 52/159 R, 169; 299/17, 5; 61/41 R, 45 R, 34

[56] References Cited

UNITED STATES PATENTS

| | | | |
|---|---|---|---|
| 294,078 | 2/1884 | Robinson | 61/34 |
| 2,272,382 | 2/1942 | McCloskey, Jr. | 52/742 |
| 2,780,935 | 2/1957 | Rumble | 52/742 |
| 3,132,852 | 5/1964 | Dolbear | 299/5 |
| 3,184,893 | 5/1965 | Booth | 52/742 |

*Primary Examiner*—Price C. Faw, Jr.
*Assistant Examiner*—Robert C. Farber
*Attorney, Agent, or Firm*—Fitzpatrick, Cella, Harper & Scinto

[57] ABSTRACT

Techniques are described for forming an elevated concrete slab-like supporting platform. A sand blanket is installed on the platform site and supporting piles are driven down through the sand blanket. A concrete slat is poured over the sand blanket and a moat is dug around its periphery. Water jet nozzles are positioned within the sand blanket prior to pouring of the concrete slab; and water conduits are also provided to extend from outside the sand blanket to the nozzles. After the concrete slab hardens, water is pumped through the conduits to form water jets at the nozzles which wash the sand blanket out from under the slab.

16 Claims, 11 Drawing Figures

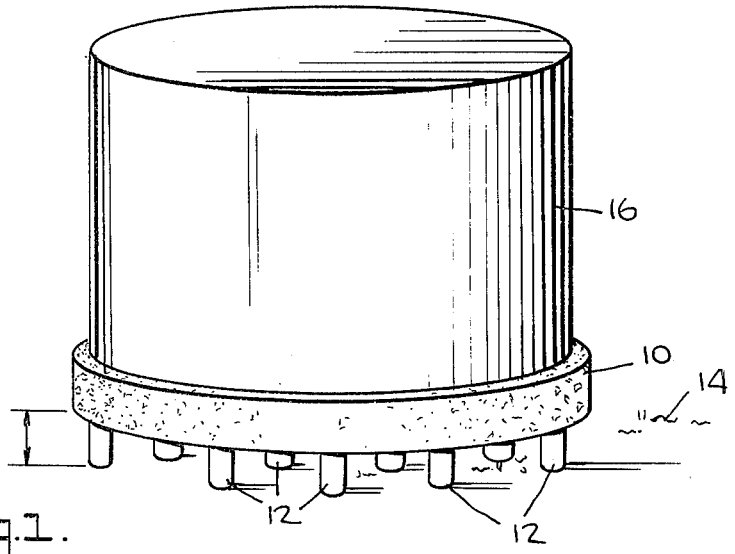
Fig.1.
Fig.5.
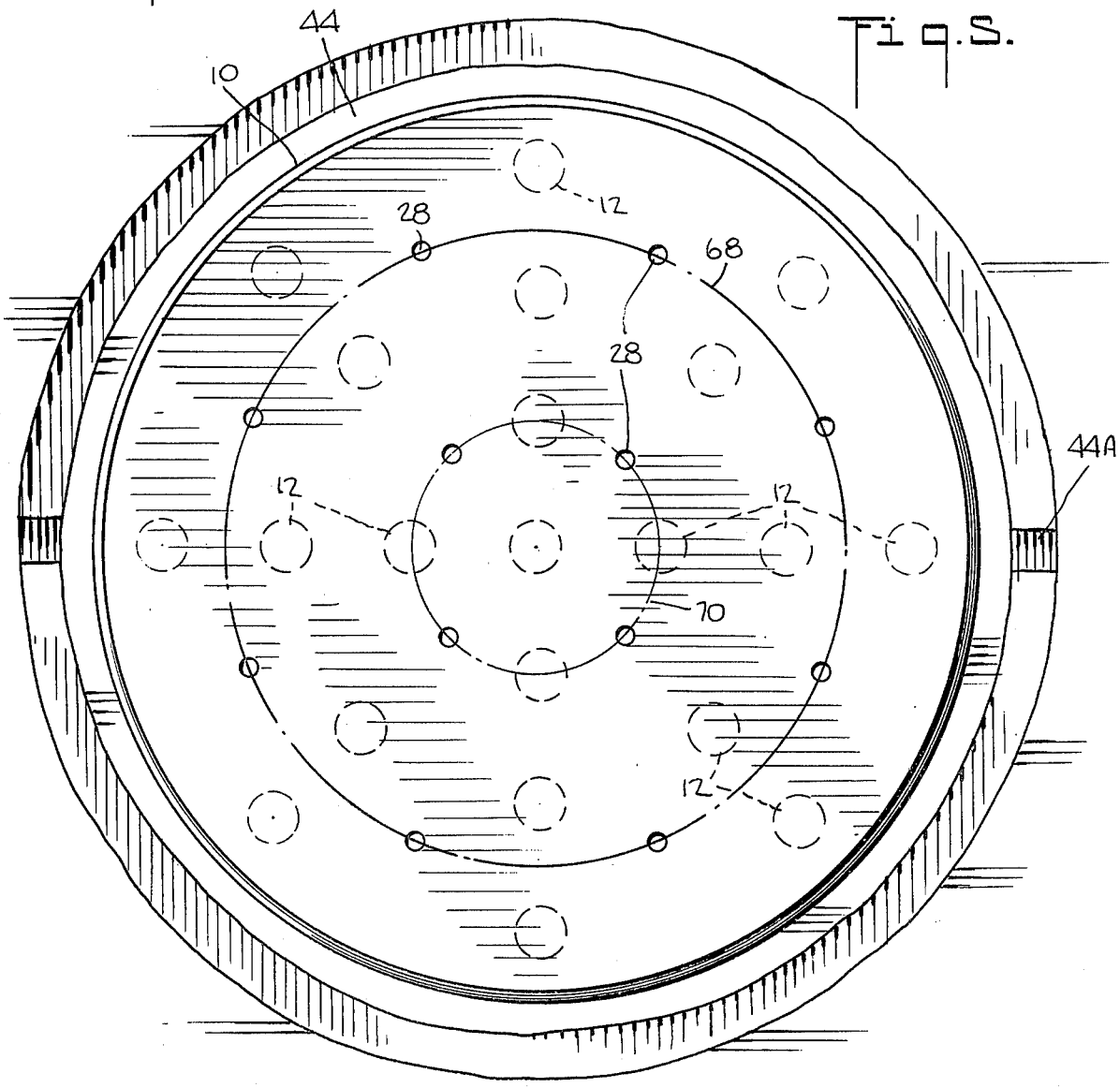

FORMATION OF ELEVATED STRUCTURES

BACKGROUND OF THE INVENTION

1. Field of the Invention

This invention relates to the construction of elevated structures and more particularly it concerns the formation of an expansive concrete slab or base supported above the earth on a plurality of piles.

2. Description of the Prior Art

In construction operations it becomes necessary, in certain instances, to form an expansive concrete supporting platform, or slab, supported a finite distance above the surface of the earth. For example, where the expansion and contraction characteristics of the soil at the construction site are such that they would cause a concrete slab lying on the surface of the earth to crack due to bending, such bending and cracking can be avoided by supporting the slab above the surface of the earth. Also, where the slab is to be used for the support of a tank or other structure to be maintained at a specific temperature (e.g. a cyrogenic tank), heat losses through the slab can be substantially reduced by supporting the slab up off the surface of the earth. Further, some structures require access for workmen, or equipment, from underneath the structure from time-to-time during its operation; and, accordingly, such structures are best supported on an elevated platform.

U.S. Pat. No. 2,780,935 to R. W. Rumble describes a prior art method of making an elevated floor slab. According to this method, a foundation is formed in a peripheral trench dug into the earth and a concrete floor slab is then poured on the surface of the earth in contact with the upper end of the foundation. After the floor slab has hardened, a workman descends into a trench previously dug under the slab; and he progressively scrapes away a layer of earth into the trench so that the slab ultimately is supported above a layer of earth.

U.S. Pat. No. 2,272,382 to M. H. McCloskey, Jr. describes a prior art method of constructing arched structures such as underground hangars for airplanes. According to this patent, the structure is formed by first excavating the earth according to a configuration such that the earth serves as a form for the underside of the finished structure. Concrete is then poured over the thus-excavated earth; and after it hardens earth is dug out from under the poured concrete structure.

In both the Rumble and McCloskey techniques a slab is formed at ground level, or lower, and the earth must thereafter be dug out from under the slab. Difficulties arise in such structures because in those cases where the earth is capable of being used as a support for the pouring of a concrete slab it is very often so stiff or hard that subsequent excavation is rendered difficult. Further, the difficulty of excavating under a previously cast concrete slab is compounded because the earth which is dug away must be transported in some manner from under the slab. Rumble shows a previously excavated trench extending under the slab site into which the earth may be scraped. However, the provision of such trench requires the construction of a temporary roof to support the concrete before it hardens. Attempts have been made in the past to remove the sand blanket by directing a water hose at it; but this was very difficult because of the limited space available for the workman handling the hose and because large amounts of sand and water would flow back at him.

SUMMARY OF THE INVENTION

The present invention provides novel techniques for forming an elevated concrete structure without the difficulties described above in connection with the prior art. According to one aspect of the present invention, a plurality of spaced apart support elements, such as piles, are installed in the earth at the site where the elevated platform is to be formed. A mold is provided to surround the support elements at their upper ends. This mold is preferably provided on top of a sand blanket through which the piles extend. Water jet nozzles are pre-positioned under the mold, i.e., they are embedded in the sand blanket; and water conduits are arranged to extend from outside the blanket to the nozzles. A concrete slab is then poured in the mold and is allowed to harden in contact with the upper ends of the piles. Thereafter, the sand blanket is washed away from under the concrete slab by pumping water through the conduits and the embedded nozzles.

According to a further aspect of the invention, after the slab or platform has been poured and has hardened, a trench is dug in the earth around the slab to form a moat. As jets of water are directed at the sand blanket under the slab, the water and sand wash down as a slurry into the moat. The sand settles out from the water in the moat and the water may thereafter be reused for further jetting until the entire sand blanket has been effectively transferred to the moat.

There has thus been outlined rather broadly the more important features of the invention in order that the detailed description thereof that follows may be better understood and in order that the present contribution to the art may be better appreciated. There are, of course, additional features of the invention that will be described more fully hereinafter. Those skilled in the art will appreciate that the conception on which this disclosure is based may readily be utilized as the basis for various modifications and equivalent methods for carrying out the several purposes of the invention. It is important, therefore, that this disclosure be regarded as including such modifications and equivalent methods as do not depart from the spirit and scope of the invention.

BRIEF DESCRIPTION OF THE DRAWINGS

Selected embodiments of the invention have been chosen for purposes of illustration and description and the various structural arrangements which may be used in practicing these embodiments are shown in the accompanying drawings forming a part of this specification where:

FIG. 1 is a perspective view of an elevated slab or platform structure formed according to the principles of the present invention;

FIG. 6 is a view similar to FIG. 4 but showing a still further step in the carrying out of the present invention;

DETAILED DESCRIPTION OF THE PREFERRED EMBODIMENT

Figure 2:
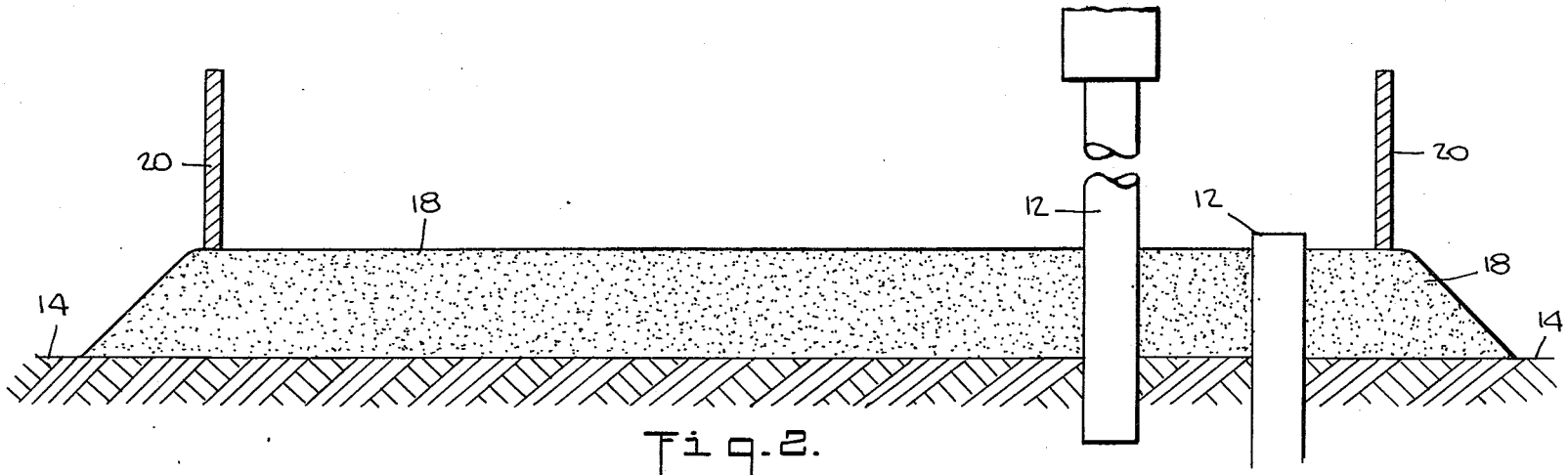
FIG. 2 is a cross-sectional view of a slab molding form and pile support arrangement as they appear in a preliminary step in the formation of the elevated platform structure of FIG. 1.

As shown in FIG. 1, an expansive concrete slab or platform 10 is supported on a plurality of vertical piles 12 at a height H above the surface of the earth 14. A large tank such as a cyrogenic tank 16 is supported on the slab or platform 10 and is thereby isolated from the effects of temperature changes which may occur in the earth 14. In addition, the slab or platform 10 and the tank 16 are also isolated from most earth movements caused by contraction or expansion due to temperature and moisture variations. The platform 10 may be of any size necessary to support the tank 16; and in general, it will be supported from approximately 2 to 5 feet above the earth's surface.

As shown in FIG. 2, the initial step in constructing the platform and pile construction of FIG. 1 involves the provision of a sand blanket 18 on the surface of the earth 14. A temporary form 20 extends from the upper surface of the sand blanket 18 up to a height at least as high as the upper surface of the elevated slab or platform to be formed. This temporary form 20 also defines the perimeter surface of the platform to be formed. Further, the upper surface of the sand blanket 18 coincides with the bottom surface of the platform to be formed; and, accordingly, the thickness of the sand blanket 18 coincides with the height of the elevated platform. Also shown in FIG. 2 is a pile driving hammer 22 which is used to drive piles 12 down through the sand blanket 18 and into the earth 14 to a bearing region which is capable of supporting the slab or platform as well as the structure to be supported thereon. As shown in FIG. 2 the form 20 surrounds the upper end of the piles 12. Other pile installation techniques may be employed, e.g. cast-in-place piles may be installed; and if desired, the piles 12 may be installed before the sand blanket 18 is laid. It will be noted from FIG. 2 that the piles 12 are installed at a depth such that their upper ends are at or slightly above the upper level of the sand blanket.

Figure 3:
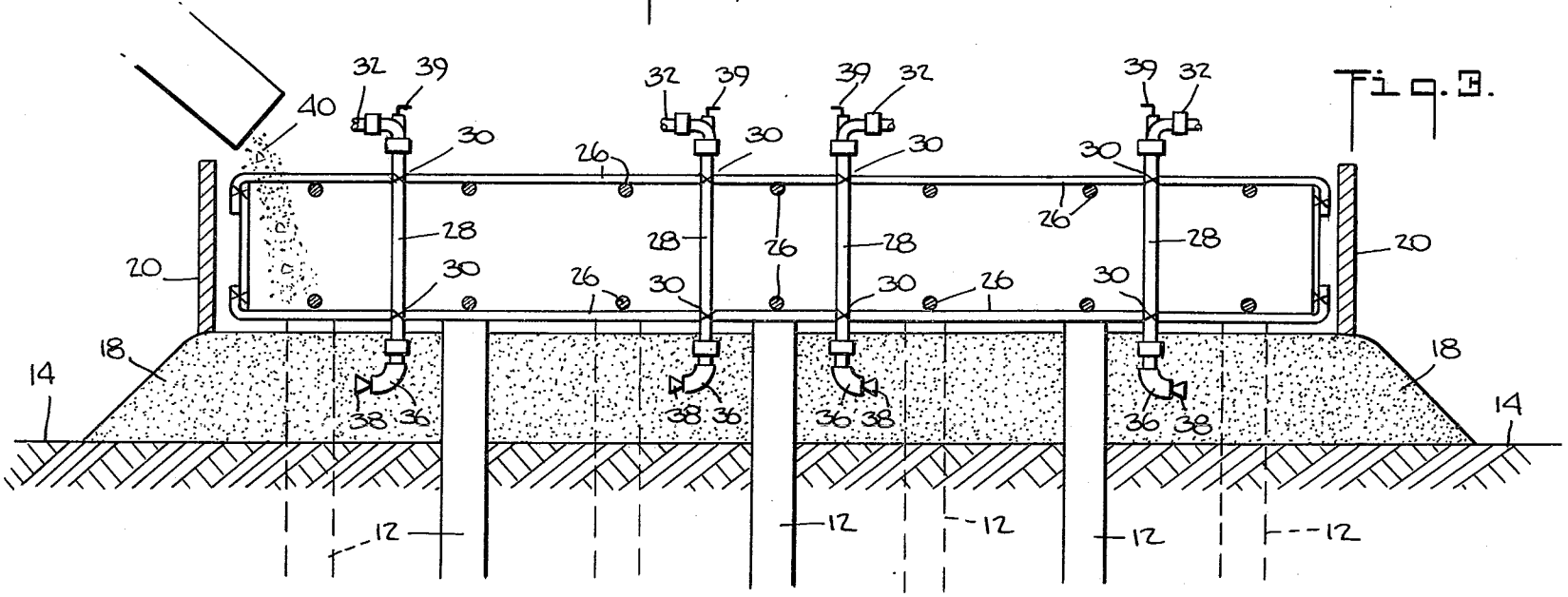
FIG. 3 is a view similar to FIG. 2 but showing a subsequent step in the formation of the elevated platform structure of FIG. 1.

After a sufficient number of the piles 12 have been installed, a framework, constituting a plurality of reinforcing bars 26, is positioned inside the temporary form 20, as shown in FIG. 3, to provide strengthening internal bracing for the platform to be formed. At the same time a plurality of vertical water conduits 28 are mounted within the temporary form 20. These water conduits may be fastened to the reinforcing bars 26 by means of wires 30. The water conduits 28 are provided at their upper ends with hose connectors 32 located above the upper level of the platform to be formed. Swivel elements 34 are connected to the lower ends of the water conduits 28 and a 90° elbow 36 with a nozzle 38 is mounted beneath each of the swivel elements 34. As can be seen in FIG. 3, these nozzle elements extend approximately one-half way down into the sand blanket 18. Control handles 39 extend out from the hose connectors 32 to control the direction of the nozzles 38, as will be explained hereinafter.

Figure 4:
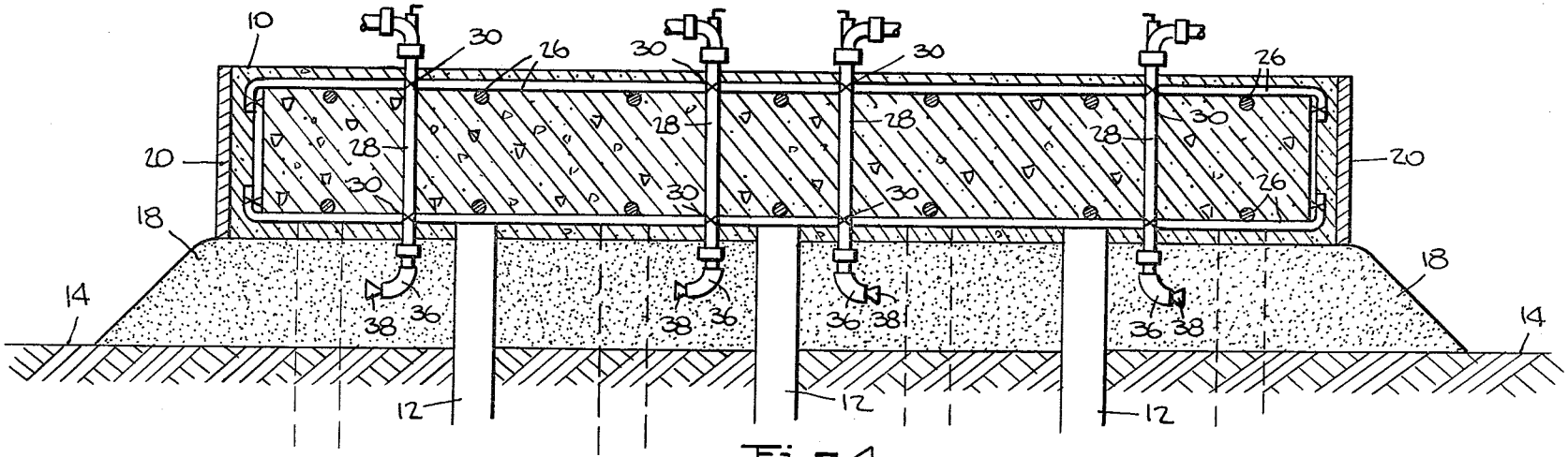
FIG. 4 is a view similar to FIG. 3 but showing a further step in the carrying out of the present invention.

After the water conduits and associated swivel elements, elbows and nozzles have been installed, liquid concrete 40 is poured into the temporary form 20 on top of the sand blanket 18 to fill the interior of the temporary form 20 up to a level above the reinforcing bars 26, thereby forming the platform 10 as illustrated in FIG. 4. The poured concrete fills the spaces between the reinforcing bars 26 and it surrounds the water conduits 28 so that the reinforcing bars and water conduits become embedded in the platform 10. Also, the platform 10 hardens about the tops of the piles 12 so that the platform is integrally connected to the piles.

Figure 5:
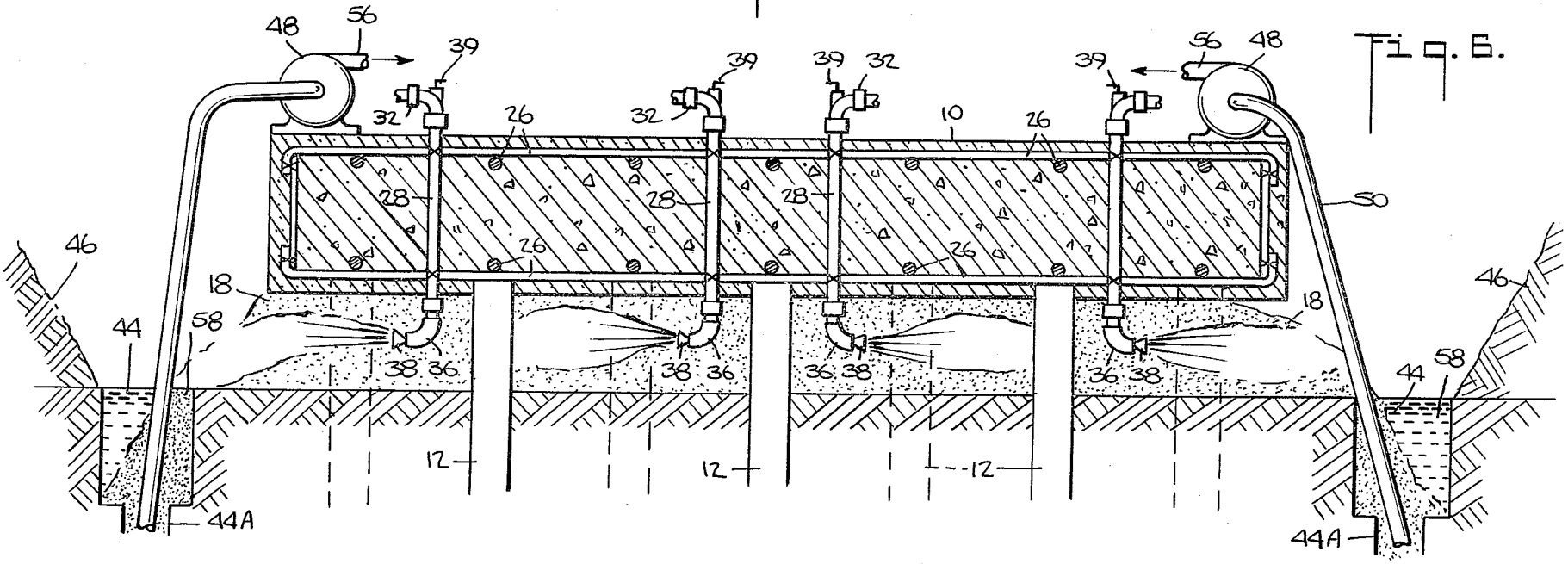
FIG. 5 is a plan view taken along line 5—5 of FIG. 4.
Figure 7:
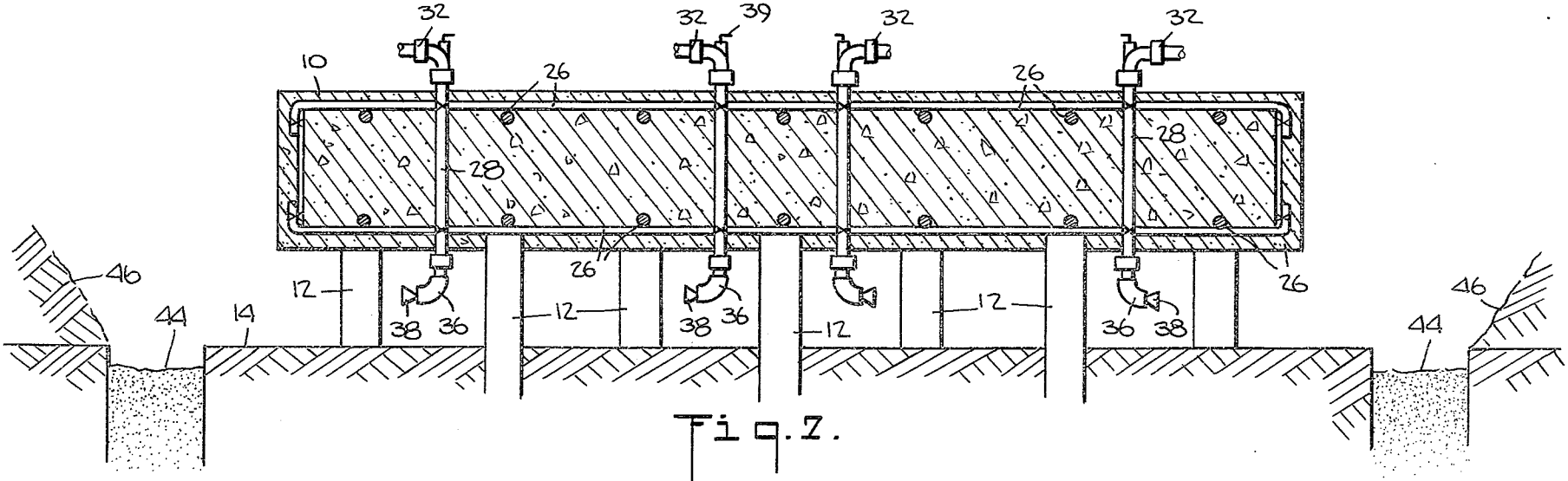
FIGS. 7 and 8 are views similar to FIG. 6 but showing final steps in the carrying out of the method of the present invention.
Figure 8:
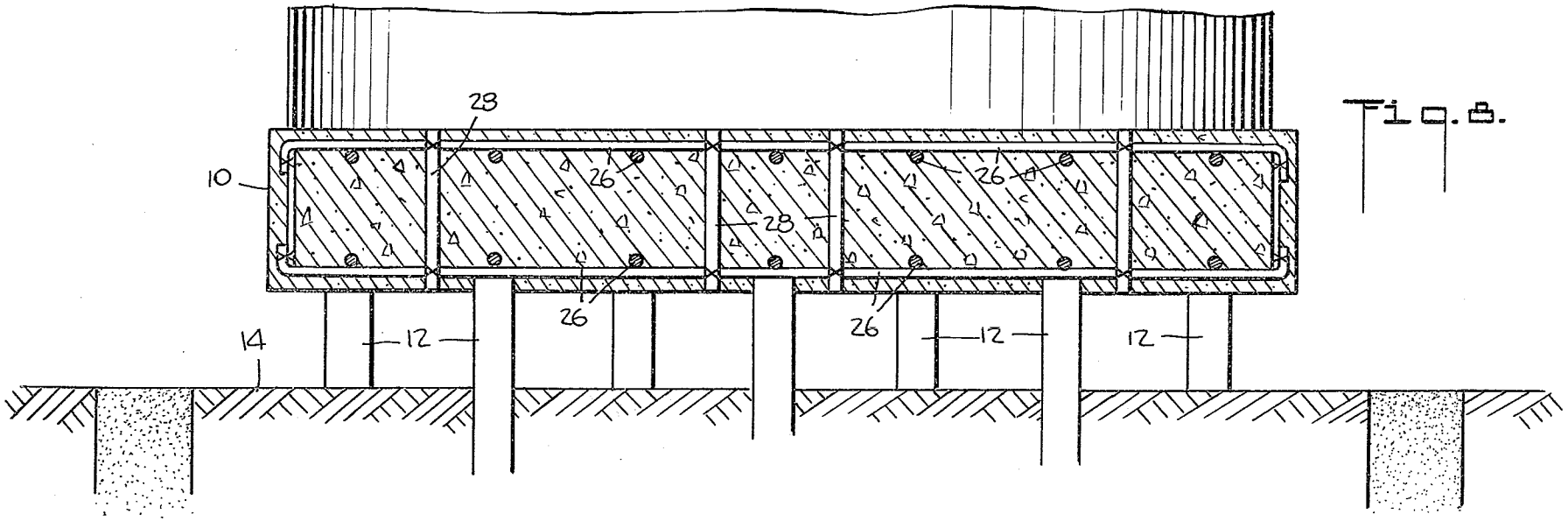

After the concrete in the platform 10 has hardened, a trench or moat 44 is dug around the perimeter of the temporary form 10 as illustrated in FIG. 5; and the earth removed from the moat may be piled just outside it as shown at 46 in FIG. 6. On opposite sides of the moat a deep cavitation 44A is dug to receive run off of water. Also, as shown in FIGS. 5 and 6, water pumps 48 are arranged with input lines 50 extending down into the moat cavities 44A and with their outputs connected to water supply lines 56. These water supply lines can be coupled to each of the hose connectors 32 at the upper ends of the water conduits 28. The temporary form 20 is then removed and the moat 44 is filled with water. The pumps 48 are put into operation and water is drawn from the moat through the line 50 and is directed down to each of the water conduits 28 and out through the nozzles 38 to which the lines 56 are connected. This causes a washing out of the sand blanket 18 from under the platform 10; and a slurry of sand and water flow outwardly from under the platform and into the moat 44. The sand in the moat 44 settles to the bottom of the moat as indicated at 58 in FIG. 6. It will be noted that the intake ends of the lines 50 in FIG. 6 are positioned in the cavities 44A so that only substantially sand free water is drawn back into the pumps 48. As shown in FIG. 7, the sand from the sand blanket 18 is eventually washed out into the moat 44 so that the moat itself becomes filled to the level of the earth 14. As the sand is washed out from the region of each nozzle 38 the water supply line is connected to another nozzle so that an adjacent region of the sand blanket will be washed away.

The moat dimensions can be calculated so that the volume of the moat corresponds substantially to the volume of the sand blanket 18 and in this way the entire sand blanket may be used to fill the moat and provide a substantially level surface around the perimeter of the now-elevated platform 10. The platform, it will be noted, is now supported by the piles 12 and not by the sand blanket.

After the sand blanket 18 has been completely removed from under the platform 10, the upper and lower ends of the water conduits 28 may be cut off flush with the upper and lower surfaces, respectively, of the platform 10; and the tank 16 or other structure to be supported on the platform 10 may then be installed.

Figure 9:
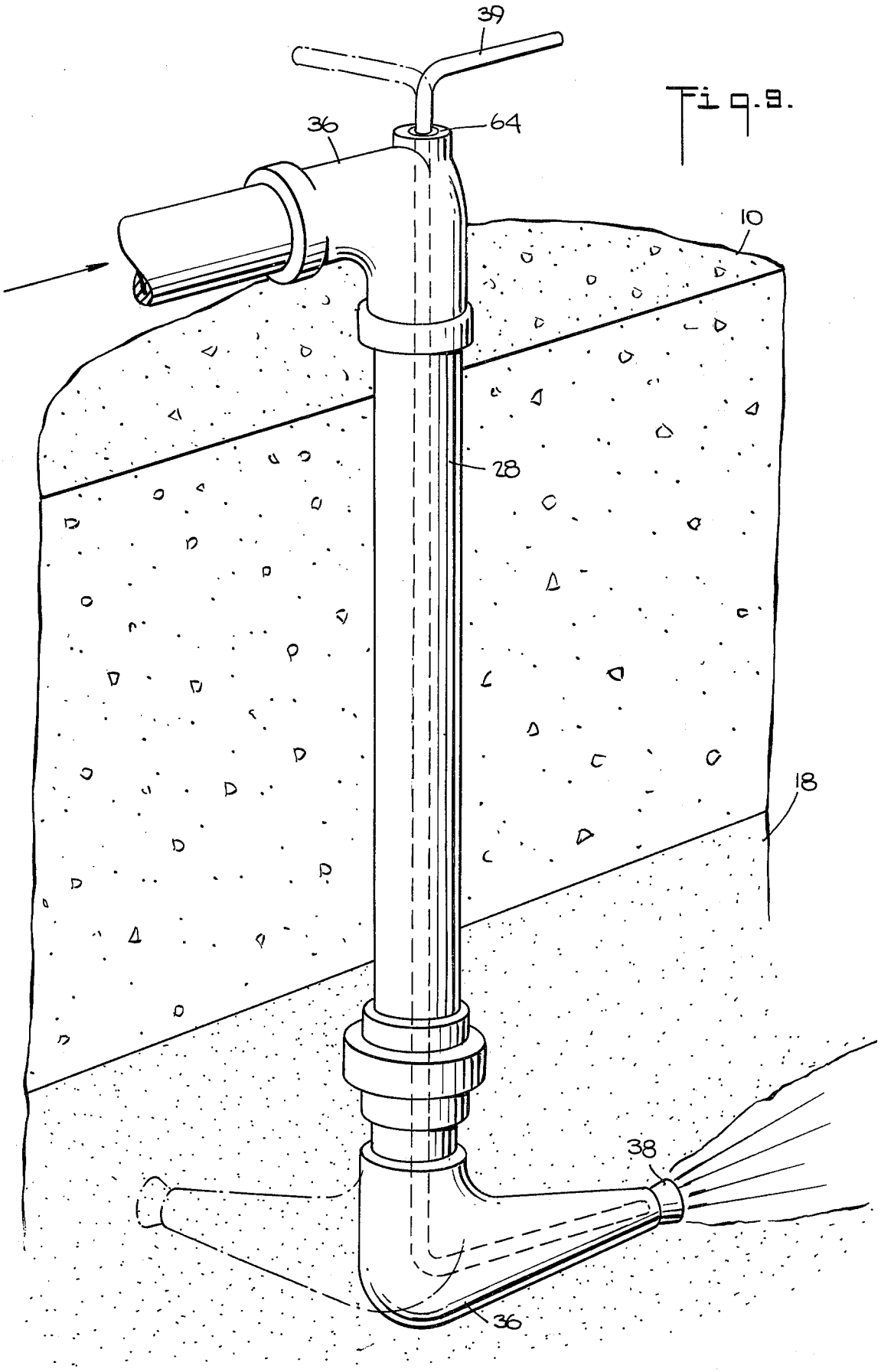
FIG. 9 is an enlarged fragmentary view illustrating a portion of the platform of FIG. 6.

In order to ensure a complete washing out of the sand blanket 18 from under the platform 10, means are provided to rotate the elbows 36 and the nozzles 38 about the longitudinal axes of their respective water conduits 28. FIG. 9 illustrates a structural arrangement for enabling this pivotal movement to be carried out from the upper surface of the platform 10. As there shown, a rod 62 extends down through the center of each of the water conduits 28 and is bent at its lower end to conform to the bend of the 90° elbow 36. The upper end of the rod 62 passes through a packing gland 64 in the hose connector 32 and is then bent to form the turning handle 39. This turning handle extends parallel to the axis of the nozzle 38; and as the turning handle is rotated the nozzle may be pointed in any desired direction. It will be appreciated that by selective control of water flow through the various water conduits and by proper manipulation of the various turning handles 39, water flow may be controlled in a manner to effectively remove the entire sand blanket 18 from under the platform.

Reverting now to FIG. 5, it will be seen that the various water conduits 28 in the platform 10 are arranged in concentric rings indicated by phantom lines 68 and 70. Preferably, the sand blanket 18 is washed out beginning near its outer periphery by first connecting the water supply line 56 to the conduits 28 which supply the outer ring 68 of the nozzles 38. Thereafter, the water flow from the pump 48 is directed through the water conduits 28 forming the inner ring 70 so that the remaining portion of the sand blanket can be washed out to the moat 44.

Figure 10:
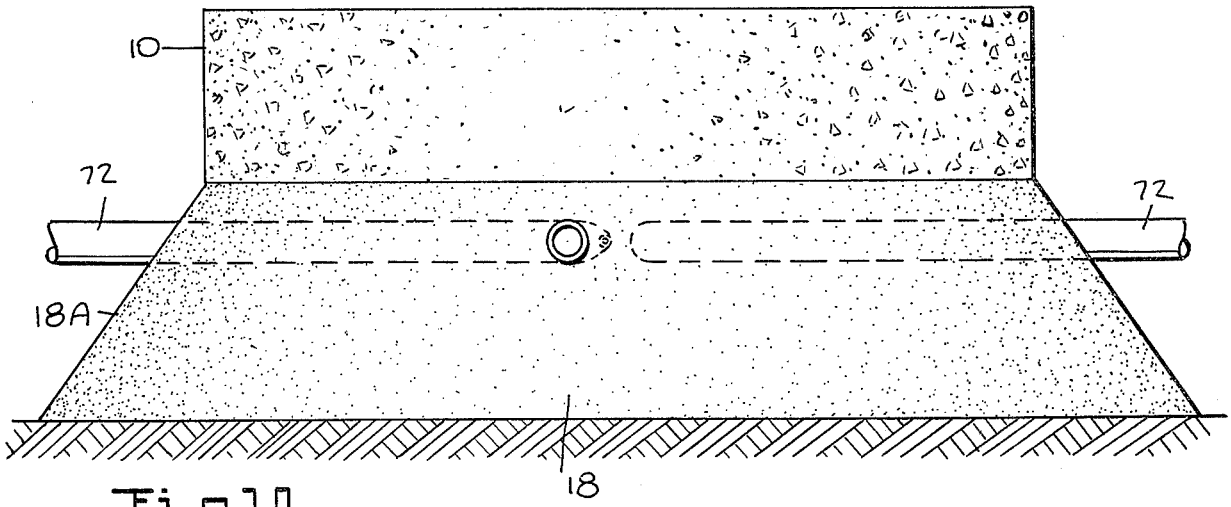
FIG. 10 is a view similar to FIG. 6 but showing an alternate arrangement for carrying out the invention.
Figure 11:
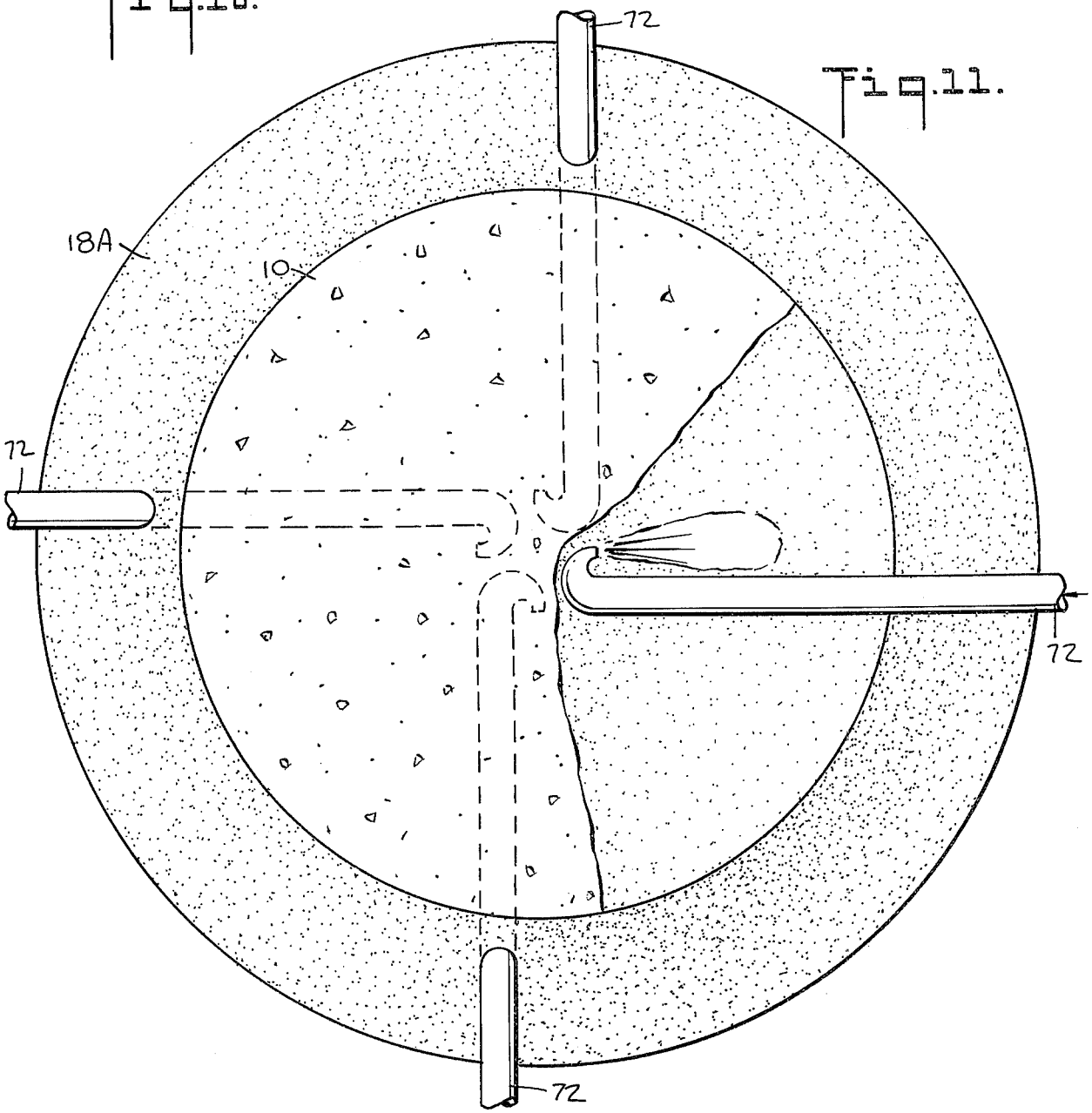
FIG. 11 is a top plan view of the arrangement of FIG. 10.

In some instances it may not be possible or allowable to form the platform 10 with water conduits 28 extending through it. In such case, the arrangement shown in FIGS. 10 and 11 may be utilized. As there shown, a plurality of water conduits 72 are embedded in the sand blanket 18; and these water conduits extend horizontally under the slab or platform 10 to the periphery of the sand blanket where they are connected to external manifolds (not shown) from which they receive water to be used in jetting out the sand blanket. During the jetting operations the conduits 72 may be rotated about their longitudinal axes and moved laterally so that the entire area under the slab can be jetted out without the necessity to have men work under the platform.

It will be appreciated from the foregoing that a sand blanket, which is used as the supporting means for molding a concrete slab, can be removed conveniently and quickly from under the slab after the concrete has hardened. This is achieved by previously embedding water jet nozzles in the sand blanket prior to pouring the concrete slab and connecting conduits to the nozzles. As a result the sand blanket is washed away by water jets. However, the water jets originate not from outside the sand blanket but rather from within it; and as a result no backflows are produced. Instead, the water jets and the washing flows of water and sand are in a direction outwardly of the sand blanket and not into it as in the prior art. Further, by prearranging the nozzles and conduits within the sand blanket as described herein the washing action can be carried out and controlled by workmen from outside the work location. This avoids an otherwise very difficult and potentially dangerous situation.

It has been found that although the water jets, in accordance with the present invention, are previously embedded in a sand blanket prior to pouring of concrete, no substantial or detrimental back pressure results when water is pumped through them. This is because the interstices between the sand grains allows water to flow outwardly from the nozzles without plugging them.

Having thus described the invention with particular reference to the preferred forms thereof, it will be obvious to those skilled in the art to which the invention pertains, after understanding the invention, that various changes and modifications may be made without departing from the spirit and scope of the invention as defined by the claims appended hereto.

What is claimed and desired to be secured by Letters Patent is:

1. A method of constructing an elevated platform, said method comprising the steps of providing a blanket of sand on the earth, installing a plurality of spaced apart support elements to extend from a bearing region in the earth beneath the sand blanket and up to a location near the top of said sand blanket, embedding water jet nozzles in said sand blanket with water conduits extending from outside said sand blanket to said nozzles, forming a mold surrounding said plurality of support elements at their upper end, with the upper surface of said sand blanket forming the bottom of said mold, pouring concrete into said mold and allowing it to solidify in contact with the upper ends of said support elements and to form a platform supported by the support elements, and thereafter washing out the sand from between said support elements under the platform by pumping water through said conduits and causing jets of water to be directed from said nozzles.

2. A method according to claim 1 wherein said water jet nozzles are distributed at various distances from the periphery of said sand blanket and wherein said water is pumped first through the nozzles closest to said periphery and thereafter through the nozzles farther from said periphery.

3. A method according to claim 1 wherein said water jet nozzles are moved while causing jets of water to be directed from them.

4. A method according to claim 1 wherein said conduits are embedded in and extend down through said slab.

5. A method according to claim 4 wherein said conduits are cut off flush with the surface of said slab after removal of said sand blanket.

6. A method according to claim 5 wherein said nozzles are mounted to turn with respect to said conduits.

7. A method according to claim 6 wherein said nozzles are turned by rotation of rods extending down through said consuits.

8. A method according to claim 1 wherein said conduits are arranged to extend horizontally into said sand blanket under said mold.

9. A method according to claim 8 wherein said nozzles are moved by moving said conduits while causing jets of water to be directed from said nozzles.

10. A method according to claim 1 wherein a moat is dug in the earth around the periphery of said mold after said slab has hardened.

11. A method according to claim 10 wherein said moat is dug to have a volume substantially equal to the volume of said sand blanket.

12. A method of forming an elevated structure comprising the steps of installing support elements to extend into the earth from a bearing region in the earth up to the surface of the earth, providing a mold on a bed of sand surrounding the upper ends of said piles, pouring concrete into said mold and allowing the concrete to harden into a slab, digging a moat in the earth adjacent to and surrounding said slab, said moat having a volume corresponding substantially to the volume of said bed of sand from under the slab and thereafter directing jets of water into the sand under the slab to wash said earth into the moat.

13. A method according to claim 12 wherein water for said jets is recirculated from said moat.

14. A method according to claim 12 wherein said moat is formed with cavities extending down from the bottom thereof to accumulate runoff water.

15. A method according to claim 12 wherein the earth which is dug during formation of said moat is piled up outside its outer periphery.

16. A method according to claim 12 wherein said jets of water are directed from within said bed of sand outwardly toward said moat.

* * * * *